US005400457A

United States Patent [19]

Ridgley

[11] Patent Number: 5,400,457

[45] Date of Patent: Mar. 28, 1995

[54] COLLAPSIBLE TOOTHBRUSH

[76] Inventor: James T. Ridgley, 6420 Lookout Dr., Cocoa, Fla. 32927-8435

[21] Appl. No.: 231,765

[22] Filed: Apr. 25, 1994

[51] Int. Cl.[6] ..... A46B 9/04

[52] U.S. Cl. ..... 15/167.1; 15/144.4; 15/145; 15/172; 15/176.2

[58] Field of Search ..... 15/143.1, 144.3, 144.4, 15/145, 167.1, 172, 176.1, 176.2, 176.6, 184, 185

[56] References Cited

U.S. PATENT DOCUMENTS

| | | | |
|---|---|---|---|
| 1,140,690 | 5/1915 | Lipari | 15/184 |
| 1,166,269 | 12/1915 | Smith | 15/184 |
| 1,192,298 | 7/1916 | Gerstenzang | 15/184 |
| 1,706,555 | 3/1926 | Weis | 15/172 |
| 2,641,012 | 6/1953 | Storrs | 15/144.4 |
| 4,135,274 | 1/1979 | Freeman | 15/144.4 |
| 4,399,582 | 8/1983 | Ernest et al. | 15/145 |
| 4,461,053 | 7/1984 | Nitzsche et al. | 15/145 |
| 4,693,622 | 9/1987 | Booth | 15/167.1 |
| 4,866,809 | 9/1989 | Pelletier | 15/167.1 |
| 5,144,712 | 9/1992 | Hansel et al. | 15/167.1 |

FOREIGN PATENT DOCUMENTS

| | | | |
|---|---|---|---|
| 600159 | 2/1926 | France | 15/145 |
| 206399 | 11/1939 | Switzerland | 15/143.1 |

*Primary Examiner*—Mark Spisich
*Attorney, Agent, or Firm*—Hugh E. Smith

[57] ABSTRACT

A toothbrush comprising a multi-section telescoping stainless steel tubular handle and rotating connector to pivotally connect a replaceable toothbrush head thereto.

5 Claims, 4 Drawing Sheets

FIG 1
PRIOR ART
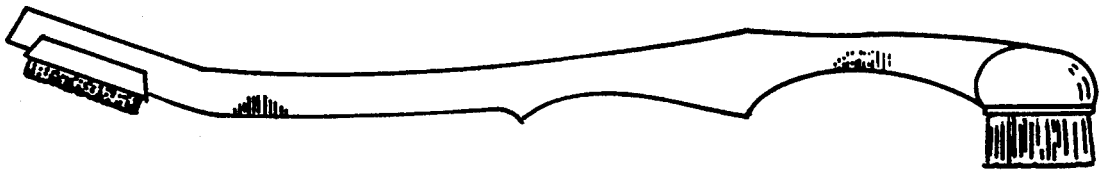
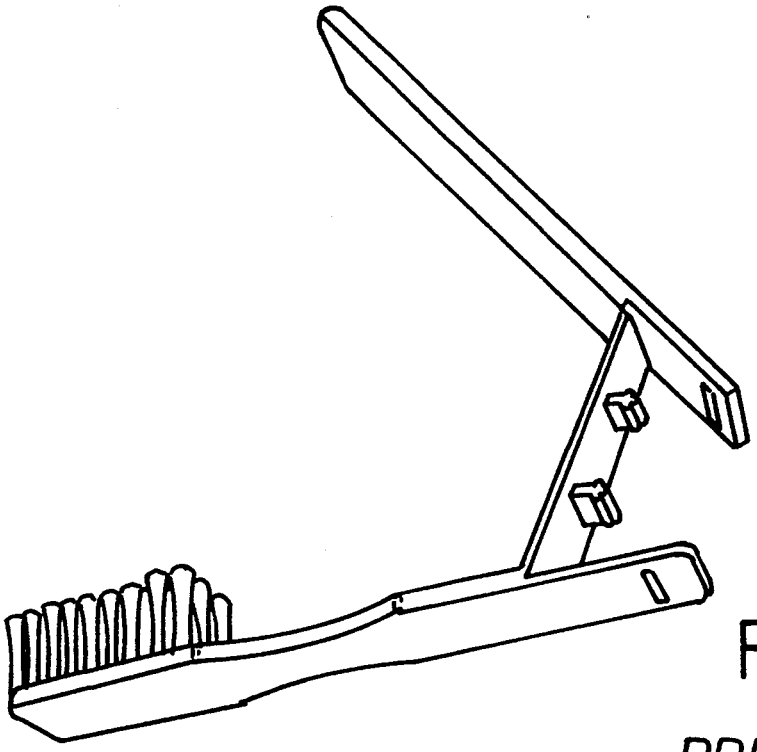
FIG 2
PRIOR ART

COLLAPSIBLE TOOTHBRUSH

BACKGROUND OF THE INVENTION

1. Field of the Invention

The present invention relates to toothbrushes and more particularly pertains to a toothbrush which may be reduced in size for travel or storage and which has a replaceable bristle head thereon.

2. Description of the Prior Art

The use of travel type toothbrushes is known in the prior art. More specifically, such brushes heretofore devised and utilized for the purpose of brushing teeth are known to consist basically of familiar, expected and obvious structural configurations, notwithstanding the myriad of designs encompassed by the crowded prior art which have been developed for the fulfillment of countless objectives and requirements. Such brushes have been provided with replaceable heads and some have provisions for folding, coming apart or otherwise reducing in size. Typical of such brushes are those illustrated in U.S. Pat. Nos. 4,850,074; 4,866,809; 4,543,679; 5,144,712; and Des. 323,745.

In this respect, the toothbrush according to the present invention substantially departs from the conventional concepts and designs of the prior art, and in so doing provides a device primarily developed for the purpose of reducing to a very small travel or storage size having a long-lasting permanent handle and a replaceable toothbrush head removably connected thereto.

Therefore, it can be appreciated that there exists a continuing need for new and improved toothbrushes which can be miniaturized when not in use. In this regard, the present invention substantially fulfills this need.

SUMMARY OF THE INVENTION

In view of the foregoing disadvantages inherent in the known types of toothbrushes now present in the prior art, the present invention provides an improved toothbrush construction wherein the same can be utilized for easy adjustment to a storage or travel size. As such, the general purpose of the present invention, which will be described subsequently in greater detail, is to provide a new and improved toothbrush which has all the advantages of the prior art devices and none of the disadvantages.

To attain this, the present invention can be briefly described as a toothbrush comprising a multi-section telescoping stainless steel tubular handle and means to pivotally connect a replaceable toothbrush head thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toothbrush which has all the advantages of the prior art brushes and none of the disadvantages.

It is another object of the present invention to provide a new and improved toothbrush which may be easily and efficiently manufactured and marketed.

It is a further object of the present invention to provide a new and improved toothbrush which is of a durable and reliable construction.

An even further object of the present invention is to provide a new and improved toothbrush which is susceptible of a low cost of manufacture with regard to both materials and labor, and which accordingly is then susceptible of low prices of sale to the consuming public, thereby making such brushes economically available to the buying public.

Still another object of the present invention is to provide a new and improved toothbrush having a long-lasting permanent handle and a replaceable bristle head therefor.

Yet another object of the present invention is to provide a new and improved collapsible toothbrush.

Even still another object of the present invention is to provide a new and improved telescoping handle toothbrush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a prior art toothbrush having a removable brush head thereon.

FIG. 2 is a perspective view of yet another prior art device showing a folding toothbrush.

DESCRIPTION OF THE PREFERRED EMBODIMENT

Figure 3:
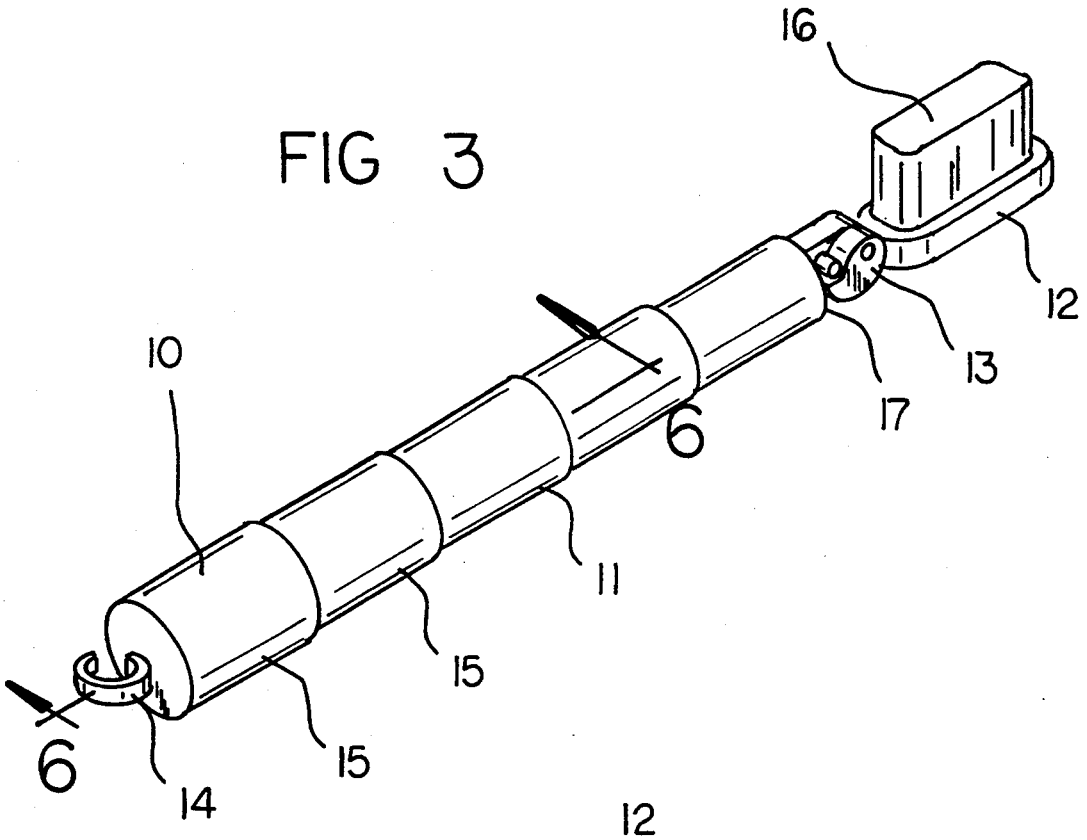
FIG. 3 is a perspective view of the toothbrush of the present invention in open position for use.

With reference now to the drawings, and in particular to FIG. 3 thereof, a new and improved toothbrush embodying the principles and concepts of the present invention and generally designated by the reference numeral 10 will be described.

Figure 4:
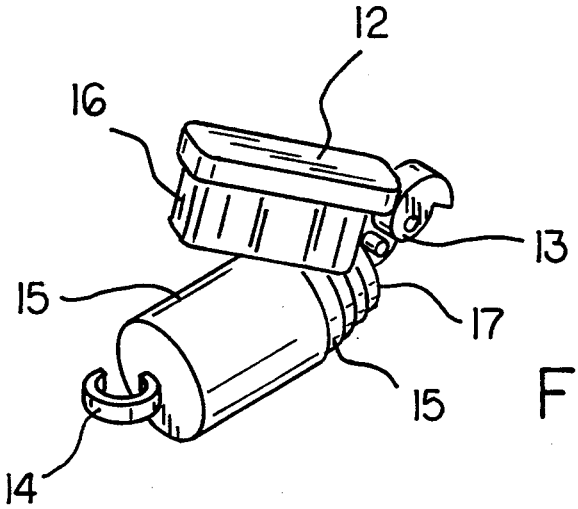
FIG. 4 is a perspective view of the toothbrush of FIG. 3 in collapsible position for storage or travel.
Figure 5:
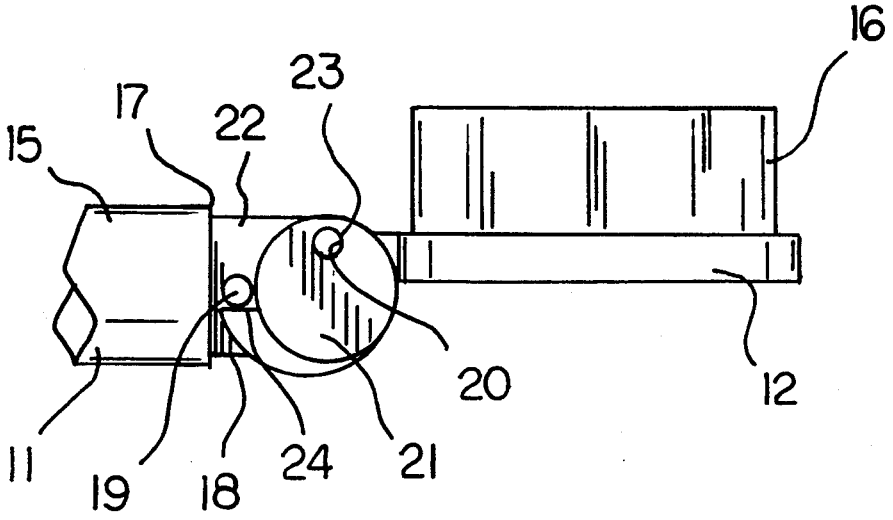
FIG. 5 is a detail plan side view of the head portion of the toothbrush of FIG. 3.
Figure 7:
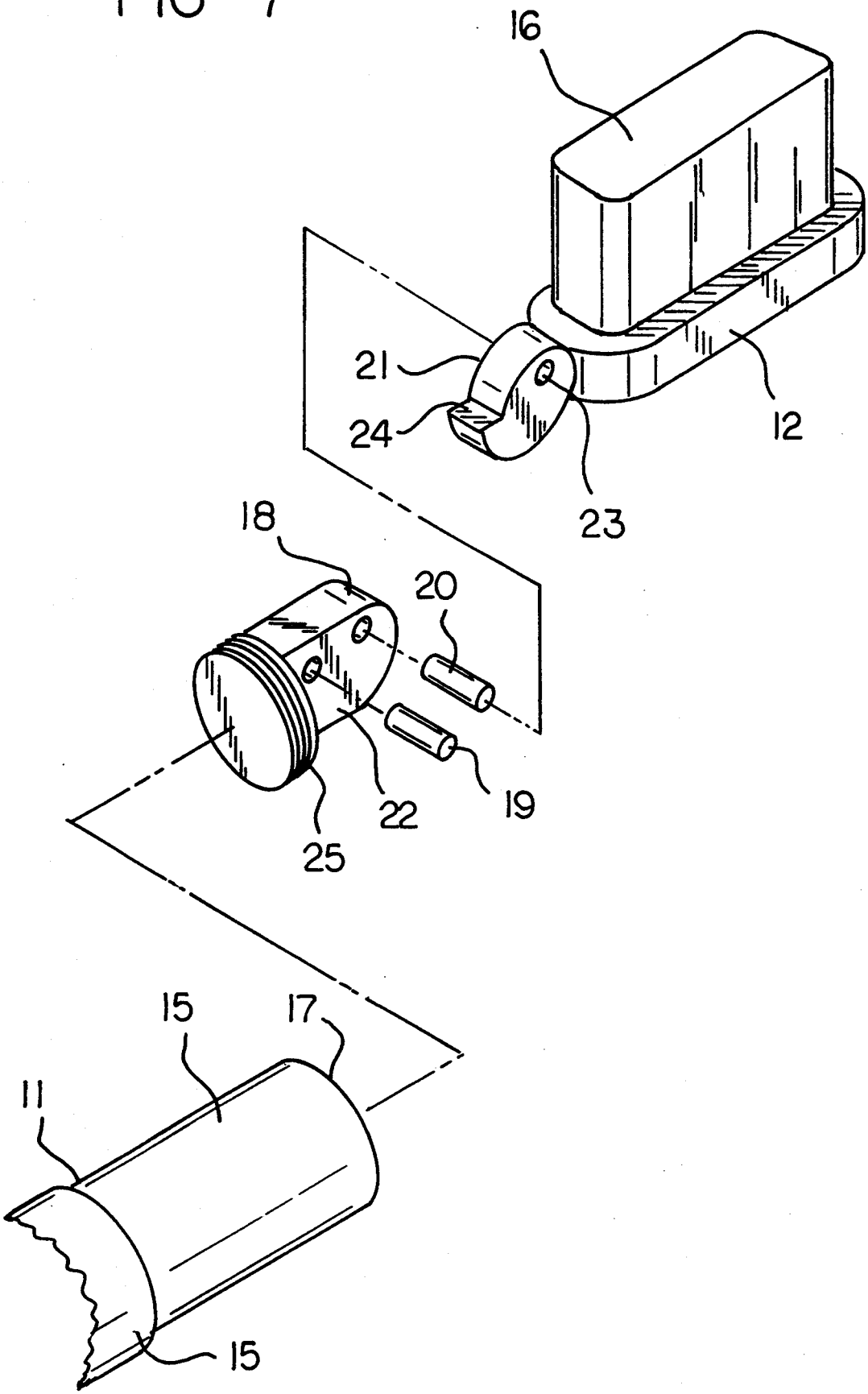
FIG. 7 is an exploded perspective view of the brush head and the means for removably connecting it to the handle of the toothbrush of the present invention.

More specifically, it will be noted that the toothbrush 10 comprises four elements, a telescoping handle section 11, a brush head 12, means 13 to connect the head 12 to the handle 11 and a hanger member 14. Handle section 11 consists of a plurality of small diameter short telescoping tubular members 15 frictionally engaging one with another and made of stainless steel, thin wall tubing. This permits the unit 10 to be collapsed into a very short format as is shown in FIG. 4 for storage or travel purposes while the frictional engagement keeps the handle extended until deliberately collapsed. Since such handle 11 is formed of stainless steel members 15 it is extremely durable and long lasting. The brush head 12 is of a much shorter life (dentists usually recommend changing brushes every three months or so) and accordingly is considered for the purposes of this invention to be a disposable item. Preferably it is constructed of plastic with synthetic bristles 16 and, as described in connection with FIGS. 5 and 7 is easily replaceable on handle 11. Hanger member 14 (also of stainless steel) permits hanging the brush unit 10 up after use if desired.

FIG. 4 illustrates the travel mode for the unit 10. Sections 15 of handle 11 are telescoped, one within another, to form a very small package, not much larger than the head 12 of unit 10. This drawing also illustrates that head 12 is pivotally mounted to the end 17 of handle 11 as is shown in more detail below.

FIGS. 5 and 7 illustrate the connection of handle 11 to brush head 12. Extending axially from the end 17 of handle 11 is a plug member 18 threaded into such end 17 of the tubular section 15. Such plug member 18 carries thereon a pair of laterally projecting circular cross-sectioned pins 19 and 20. These are not axially aligned but have one pin 20 vertically disposed above and horizontally displaced from the other pin 19. Pin 20 serves as a stop to hold head 12 at the correct angle for brushing when the brush 10 is in use. This is accomplished by providing brush head 12 with a projecting cam member 21 which slidably engages alongside the flat portion 22 of plug end and has an aperture 23 therein to fit over pin 20. Projecting from cam member 21, and defined by a spiral outer perimeter shape of the cam member, is a flat stop plate section 24 which, when brush head 12 is pivoted on pin 20, comes into engagement with top pin 19 preventing further rotation of head 12. These components are most clearly visible in FIG. 7 which also shows the threaded end 25 of plug 18. When brush head 12 is considered due for replacement, head 12 is slipped off pin 20 and replaced with a new head of the same construction.

Figure 6:
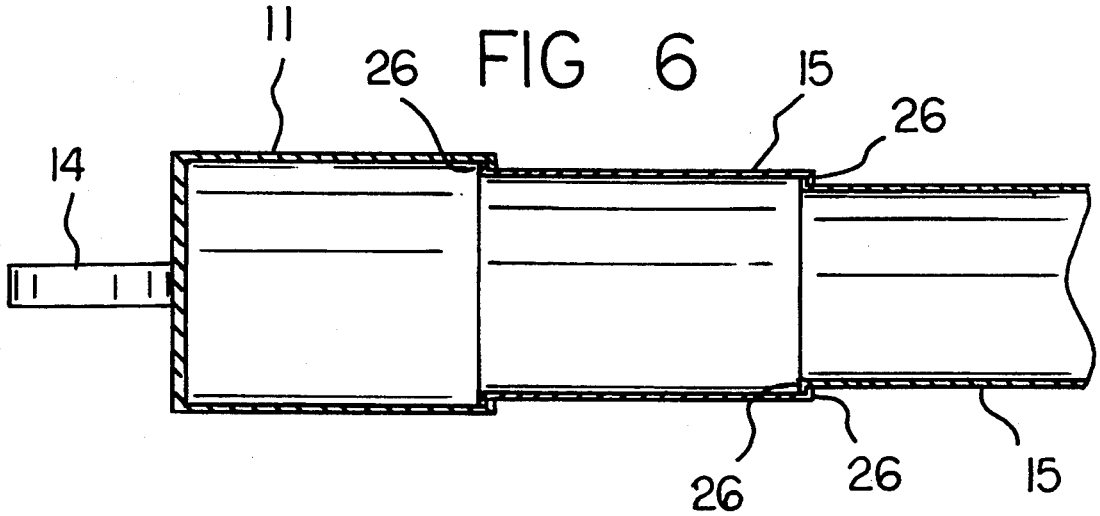
FIG. 6 is a sectional view on line 6—6 of FIG. 3.

FIG. 6 illustrates the telescoping arrangement of segments 15 in handle member 11. It will be noted that angled detents 26 are provided at the ends of each tube segment 15, such detents 26 engaging when the handle is extended and preventing separation of segments 15 from each other.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A collapsible toothbrush comprising:

an elongated handle having first and second ends and including a plurality of elongated telescoping tubing sections slidably interfitted together;

a plug member threadably engaged to said first end of said handle;

a first pin projecting laterally from said plug member;

a second pin projecting laterally from said plug member, said second pin being spaced from and substantially parallel to said first pin; and, a brush head member including a cam member projecting therefrom, said cam member having a spiral outer perimeter shape defining a flat stop plate section and an aperture extending therethrough receiving said first pin to rotatably mount said cam member of said brush head member to said plug, whereby said cam member stop plate section of said cam member engages said second pin to preclude rotation of said cam member past a predetermined position.

2. The collapsible toothbrush of claim 1, wherein said tubing sections frictionally engage with one another to retain said handle in an extended position.

3. The collapsible toothbrush of claim 2, and further comprising a hanger member coupled to said second end of said handle.

4. The collapsible toothbrush of claim 1, wherein said tubing sections are provided with detents to preclude a separation of said tubular sections.

5. The collapsible toothbrush of claim 4, and further comprising a hanger member coupled to said second end of said handle.

* * * * *